US005618199A

United States Patent [19]

Conorich et al.

[11] Patent Number: 5,618,199

[45] Date of Patent: Apr. 8, 1997

[54] CONNECTOR MODULE INCLUDING CONDENSATION PROTECTION

[75] Inventors: Theodore A. Conorich, Parsippany-Troy Hills Twp., Morris County; Lawrence M. Paul, Randolph Twp., Morris County, both of N.J.

[73] Assignee: Lucent Technologies Inc., Murray Hill, N.J.

[21] Appl. No.: 442,862

[22] Filed: May 17, 1995

[51] Int. Cl.[6] ..... H01R 4/24

[52] U.S. Cl. ..... 439/404; 439/934

[58] Field of Search ..... 439/206, 397, 439/398, 402, 403, 404, 406, 660, 683, 709, 934

[56] References Cited

U.S. PATENT DOCUMENTS

| | | | |
|---|---|---|---|
| 3,523,268 | 3/1968 | Foster | 439/683 |
| 3,798,587 | 3/1974 | Ellis, Jr. et al. | 439/403 |
| 4,171,857 | 10/1979 | Forberg et al. | 439/402 |
| 4,236,778 | 12/1980 | Hughes et al. | 439/406 |
| 4,283,103 | 8/1981 | Forberg et al. | 439/207 |
| 4,343,529 | 8/1982 | Reavis, Jr. et al. | 439/406 |
| 5,516,301 | 5/1996 | Kawakita | 439/206 |
| 5,549,489 | 8/1996 | Baggett et al. | 439/709 |

OTHER PUBLICATIONS

U.S. Patent Application of Baggett et al., Serial No. 08/442,901, filed May 17, 1995.

U.S. Patent Application of Baggett et al, Serial No. 08/442,866, filed May 17, 1995 *Copy not attached.

*Primary Examiner*—Neil Abrams
*Assistant Examiner*—Brian Biggi
*Attorney, Agent, or Firm*—Lester H. Birnbaum

[57] ABSTRACT

Disclosed is a connector module which protects adjacent contacts from being shorted by condensation. Ridges are provided on a housing adjacent each contact such that water droplets of a sufficient width to bridge the distances between contacts cannot form.

5 Claims, 2 Drawing Sheets

CONNECTOR MODULE INCLUDING CONDENSATION PROTECTION

BACKGROUND OF THE INVENTION

This invention relates to modules for electrically connecting sets of wires.

In the telecommunications industry, connecting blocks comprising an array of insulation displacement contacts are typically used in Central Offices for electrical connection between cables and cross-connect wiring. One example of such a connecting block is the standard 110 connector block. (See, for example, U.S. Pat. No. 3,798,587 issued to Ellis, Jr. et al.) Such connector blocks include rows of insulation displacement contacts mounted within a plastic module. Each contact includes insulation piercing slots on both ends. One set of wires is placed within an alignment strip, and the contact module is placed over the wires in order to make contact therewith. A second set of wires is inserted into the opposite end of the contacts to complete the electrical connection between the sets of wires. In some recent systems, connector modules include slots for mounting protectors which are electrically connected to the contacts. (See, for example, U.S. Pat. Nos. 4,171,857 and 4,283,103 issued to Forberg et al.)

It has also been proposed to provide two rows of contacts in a connector module so that electrical contact can be made to wires on both surfaces of the module. (See U.S. patent application of Baggett et al. Ser. No. 08/442,866 filed on an even date herewith.) Typically, all such modules have an insulating housing or clamping element surrounding the contacts.

It is desirable to bring the contacts as close together as possible (e.g., 3.8 mm) to reduce the area of the connecting block and achieve a high density of connection. However, one problem which can occur is that water droplets from condensation can bridge the gap between adjacent contacts and create a short between these contacts.

SUMMARY OF THE INVENTION

The invention is a connector module which includes at least one row of contacts mounted within an insulating housing. Each contact includes an end portion which is capable of providing electrical connection to a corresponding wire. The housing includes a plurality of slits aligned with corresponding end portions. A plurality of ridges are provided on the housing between each slit and extend outward from the housing a sufficient distance to prevent formation of droplets extending between adjacent contacts.

BRIEF DESCRIPTION OF THE DRAWING

These and other features of the invention are delineated in detail in the following description. In the drawing.

It will be appreciated that, for purposes of illustration, these figures are not necessarily drawn to scale.

DETAILED DESCRIPTION

Figure 1:
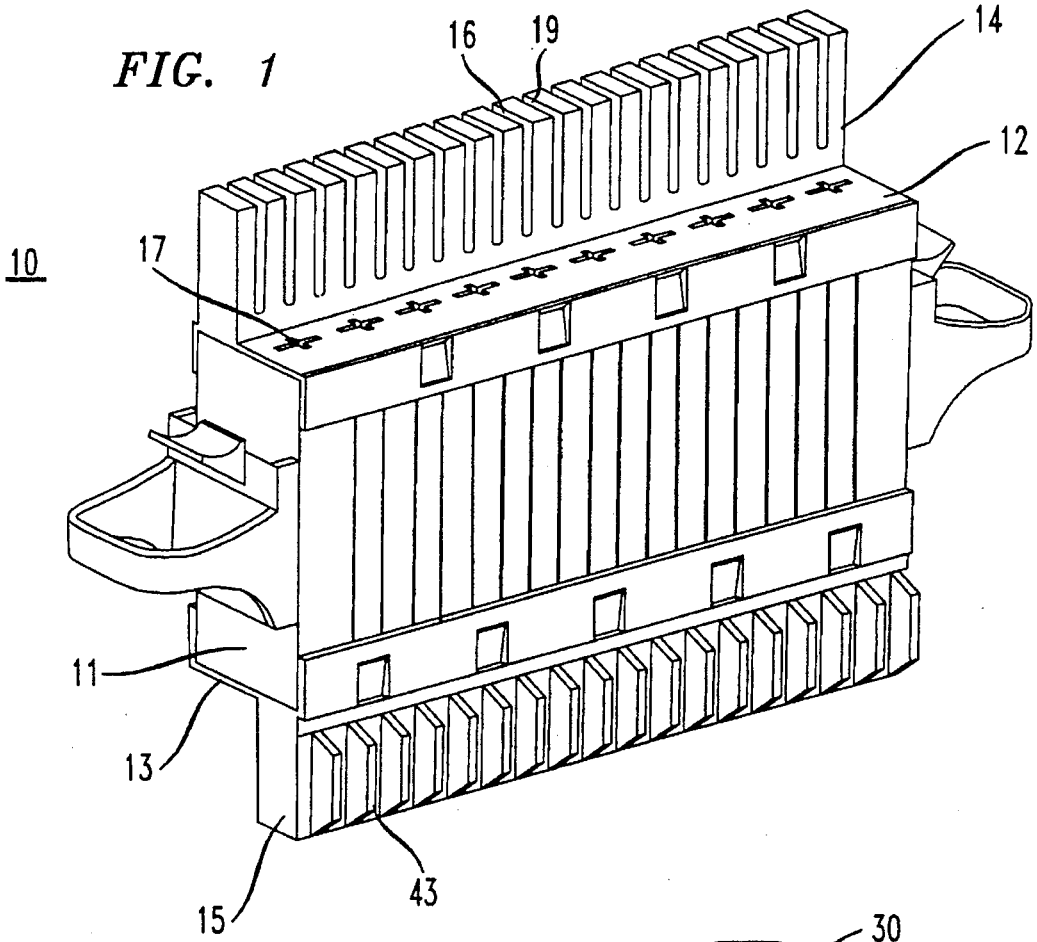
FIG. 1 is a perspective view of a connector module in accordance with an embodiment of the invention.

Illustrated in FIG. 1 is a module, 10, which can be inserted into a frame (not shown) along with other similar modules to form a connecting block. (For details concerning the mounting frame see U.S. patent application of Baggett et al. Ser. No. 08/442,901 filed on an even date herewith.) The module includes a housing comprising a body portion, 11, which is essentially rectangular and is made of insulating material such as plastic. The housing further comprises caps, 14 and 15, covering the body portion and defining top and bottom surfaces, 12 and 13, respectively. The caps can be made of the same material as the body portion. Each cap includes a series of slits, e.g., 16 and 19, which permit insertion of a wire (not shown) therein as discussed below. Each cap also includes a series of slots, e.g., 17 and 18, in the top and bottom surfaces of the housing, which slots permit insertion of leads which may be electrically coupled to a cartridge protector, a single protector, a test probe, or possibly other components.

Figure 2:
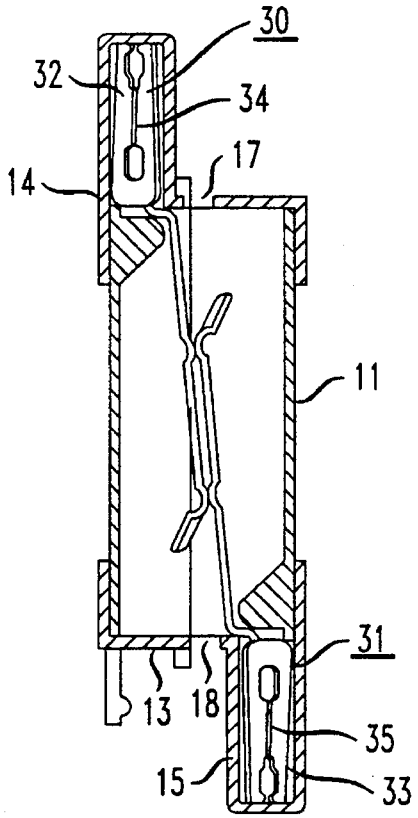
FIG. 2 is a cross-sectional view of the module of FIG. 2.

As illustrated in FIG. 2, mounted within the housing is a first row of contacts, e.g., 30, and a second row of contacts, e.g., 31. Each contact, 30 and 31, includes an end portion, 32 and 33, respectively, which is capable of providing electrical connection to a wire (not shown). In this embodiment, the end portions each comprise a slot, 34 and 35, which pierces the insulation surrounding the wire to establish electrical contact. The contacts are mounted so that the end portions of the first row of contacts, e.g., 30, protrude through the top surface, 12, of the housing, while the end portions of the second row of contacts, e.g., 31, protrude through the bottom surface, 13, of the housing. The end portions, e.g., 32, are also aligned with corresponding slits, e.g., 16 of FIG. 1, in the caps, e.g., 14 of FIG. 1, so that wires may be inserted through the caps for electrical connection by the contacts.

The remainder of the contacts, 30 and 31, also known as the stems, extend in the body, 11, so that one contact, 30, from the first row makes mechanical and electrical contact with another contact, 31, from the second row. In this embodiment, the two contacts make mechanical and electrical contact at two points, 38 and 39, as more fully discussed in U.S. patent application of Baggett et al. Ser. No. 442,863 now U.S. Pat. No. 5,549,489 filed on an even date herewith.

Figure 3:
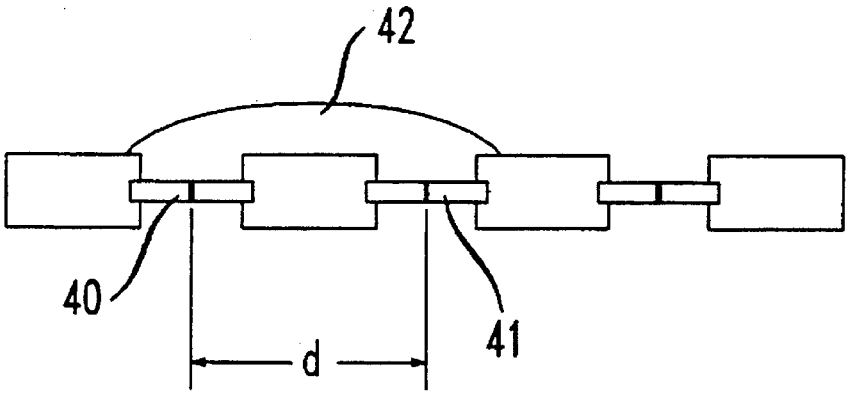
FIG. 3 (PRIOR ART)
FIG. 3 is a plan view of a portion of a prior art connector module.

Desirably, the contacts are placed less than 5.0 mm from an adjacent contact in the row. However, as illustrated schematically in the top view of FIG. 3, a typical prior art connector with contacts, e.g., 40 and 41, having a center-to-center spacing, d, which is less than 5.0 mm, can have the adjacent contacts shorted by a droplet, 42, which bridges the gap between the contacts. Such a droplet, 42, can be formed by simple condensation on the surface of the housing.

Figure 4:
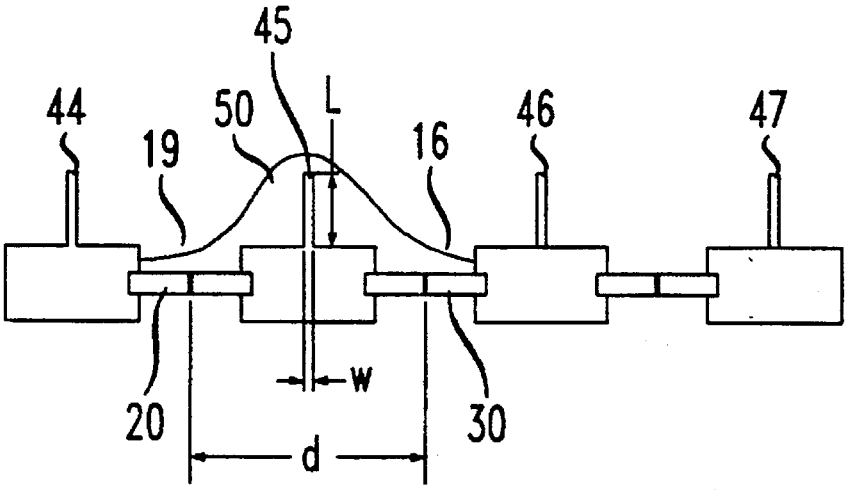
FIG. 4 is a plan view of a portion of a connector module in accordance with an embodiment of the invention.

In order to eliminate this problem, a series of ridges, e.g., 44–47 of FIG. 4 and 43 of FIG. 1, is provided in the cap portions, 14 and 15, of the connector module housing. Specifically, FIG. 4 illustrates in a plan view some of the ridges on cap 14, while FIG. 1 shows in a perspective view the ridges, e.g, 43, on cap 15. It will be noted that each ridge, e.g., 45, is provided in the gap between adjacent slits, e.g., 16 and 19, on the caps, which slits are aligned with corresponding contacts, 30 and 20, in the housing. The ridges, e.g, 45, extend outwardly from the surface of the caps, e.g., 14, by an amount, L, which, for reasons discussed below falls within the range 1.5–3 mm. The width, w, of each ridge, again for reasons discussed below, is within the range 0.4–5 mm.

As further illustrated in FIG. 4, if a droplet, 50, were to form between adjacent contacts, e.g., 20 and 30, the total bridging distance the droplet would have to extend to form a connection between the contacts would be considerably greater than the prior an connector module (FIG. 3) with the same contact spacing due to the additional distance (2 L+w) provided by the ridge, e.g., 45. If the additional distance is sufficiently great, any droplet which would otherwise form thereon will fall off the connector module due to the weight of the droplet. Thus, the module is protected from any water droplet shorting adjacent contacts.

In a specific example, with the contacts a distance, d, apart, of 3.8 mm, it is recommended that the minimum additional bridging distance (2 L+w) be at least 5.6 mm. Consequently, the ridges could extend a distance, L, of at least 2.55 mm and have a width, w, of at least 0.5 mm in this example.

Various modifications of the invention will become apparent to those skilled in the art. For example, although the invention is described with regard to a specific connector module, it will be appreciated that the invention is also applicable to other connector modules which have contacts mounted within an insulating body and which are spaced close enough together (i.e., less than 5.0 mm) so that shorting from condensation may be a problem.

The invention claimed is:

1. A connector module comprising:

an insulating housing including a body portion and a cap formed on a surface of the body portion, the cap including a plurality of spaced slits;

at least one row of contacts mounted within the housing, each contact including an end portion which is capable of providing electrical connection to a corresponding wire, said end portions being aligned with the slits in the housing; and a plurality of ridges formed in portions of the cap between the slits and extending outward from the housing a sufficient distance to prevent formation of droplets extending between adjacent slits.

2. A module according to claim 1 wherein the ridges extend outward a distance of at least 1.5 mm.

3. A module according to claim 2 wherein the ridges extend outward a distance within the range 1.5–3 mm and have a width within the range 0.4–5 mm.

4. A module according to claim 1 wherein each end portion provides electrical connection by means of an insulation piercing slot.

5. A module according to claim 1 wherein the insulating housing includes caps formed on top and bottom of the body portion, the caps defining a top and bottom surface with one row of contacts extending through the top surface and an additional row of contacts extending through the bottom surface, and the caps having slits defined therein aligned with corresponding contacts and ridges formed in portions of the caps between the slits on both caps.

* * * * *